US005615780A

United States Patent [19]

Nimetz et al.

[11] Patent Number: 5,615,780

[45] Date of Patent: Apr. 1, 1997

[54] FULL-ACCESS, NON-GRAVITY DEPENDENT, JAR STORAGE RACK

[76] Inventors: Steven A. Nimetz; Caroline H. Nimetz, both of 25 Inverin Cir., Timonium, Md. 21093

[21] Appl. No.: 550,558

[22] Filed: Oct. 31, 1995

[51] Int. Cl.[6] ..... A47F 7/28; A47F 7/00; A47B 73/00

[52] U.S. Cl. ..... 211/49.1; 211/59.2; 211/71; 211/74; 211/89; 211/120

[58] Field of Search ..... 211/49.1, 75, 120, 211/14, 89, 74, 59.2, 71; 312/45; 220/23.4, 23.83, 737; 206/446, 499

[56] References Cited

U.S. PATENT DOCUMENTS

| | | | |
|---|---|---|---|
| 2,212,129 | 8/1940 | Rust | 312/48 |
| 4,176,752 | 12/1979 | Taber | 211/89 |
| 4,305,512 | 12/1981 | MacKenzie | 211/75 |
| 5,005,710 | 4/1991 | Hofer | 211/89 |
| 5,184,735 | 2/1993 | Black | 211/14 |
| 5,419,443 | 5/1995 | Niederberger et al. | 211/89 |

FOREIGN PATENT DOCUMENTS

| | | | |
|---|---|---|---|
| 2013161 | 8/1979 | United Kingdom | 211/89 |
| 2057857 | 4/1981 | United Kingdom | 211/89 |

*Primary Examiner*—Robert W. Gibson, Jr.
*Assistant Examiner*—Donald J. Wallace
*Attorney, Agent, or Firm*—Larry J. Guffey

[57] ABSTRACT

A storage rack is provided that allows items to be stacked securely while providing full access to all the stacked items and allowing for removal of any item without having the remaining items fall under gravity to fill the void created by the removal of the selected item. More particularly, this invention relates to a device for storing foodstuffs such as jars of baby food.

4 Claims, 1 Drawing Sheet

FULL-ACCESS, NON-GRAVITY DEPENDENT, JAR STORAGE RACK

BACKGROUND OF THE INVENTION

1. Field of the Invention

This invention relates generally to storage devices that allow items to be stacked securely while providing full access to all the stacked items and allowing for removal of any item without having the remaining items fall under gravity to fill the void created by the removal of the selected item. More particularly, this invention relates to a device for storing foodstuffs such as jars of baby food.

Because baby food jars are often small and can contain a wide variety of different foods, their use usually requires storage of a large number of jars. A conventional cupboard is not suited for such storage because the jars are often randomly housed therein, thereby necessitating that their user hunt and search through all of the jars for the selection of a particular foodstuff.

The present invention provides for storage of the jars in stacked arrays wherein each of the jars is fully accessible and prevented from falling under gravity to fill the void created by the removal of a selected jar from the stacked arrays.

2. Description of the Related Art

U.S. Pat. No. 4,305,512 describes an organizer and storage rack for small canned or jarred commodities, such as foodstuffs. It provides limited access to the stored jars and, upon the removal of a jar from the rack, is susceptible to having the remaining jars fall under gravity to fill the void created by the removal of the selected jar.

U.S. Pat. No. 2,212,129 describes a can storage rack that allows for only the lowermost can from a stacked array to be accessed and removed from the stack.

Carousel types of baby food jar, storage devices are commercially available. These typically provide full access only to those jars placed on the perimeter of the carousel's rotating members.

Despite this prior art, the need exists for an invention that can provide for greater access to the stored jars and allow for the removal of individual jars without having the remaining jars fall under gravity to fill the void created by the removal of the selected jar.

SUMMARY OF THE INVENTION

The present invention is generally directed to satisfying the need set forth above. More particularly, this invention is directed to an improved jar storage rack that provides greater access to the stored jars, while eliminating the possibility for the remaining jars to fall under gravity to fill the void created by the removal of the selected jar.

In accordance with one preferred embodiment of the present invention, the foregoing need can be satisfied by providing a full-access, non-gravity dependent, jar storage rack that is comprised of an elastic body and a planar mounting member.

The elastic body includes front, rear, top and bottom surfaces and a jar receiving bore. The bore has top and bottom portions, and an interior surface.

The longitudinal axis of the bore is located so that its interior surface intersects the body's front surface so as to define a slot that provides access through the body's front surface to jars stored in the bore. The slot's width is chosen so as to allow a user's fingers to grasp and remove a jar through the slot in the body's front surface.

The elastic properties of the body and the bore's diameter are chosen so as to allow the bore's interior surface to be expanded by a jar's entry into the bore, and to yield a biasing force against a jar which is sufficient in magnitude to prevent the jar from slipping in the bore under the force of gravity.

The planar mounting member has front and rear surfaces and a bottom edge. The elastic body's rear surface is secured to the mounting member's front surface.

In another preferred embodiment, the bore extends between the body's top and bottom surfaces, and the bore's interior surface has corrugations that are aligned parallel to the bore's longitudinal axis. These corrugations allow the bore to accommodate a wider range of jars with differing diameters.

When the bore extends to the body's bottom surface, a base is added to the rack. The base has a rear edge and a top surface, with the rear edge being connected to the planar mounting member's bottom edge. The rack's base is configured so that its top surface prevents jars in the rack's bore from being forced out the bottom portion of the bore.

This new and improved, jar storage device is seen to achieve its object of eliminating the undesirable characteristics of "limited jar access" and "falling jars" that are common to prior art devices.

Other objects and advantages of this invention will become readily apparent as the invention is better understood by reference to the accompanying drawings and the detailed description that follows.

DESCRIPTION OF THE PREFERRED EMBODIMENT

Figure 1:
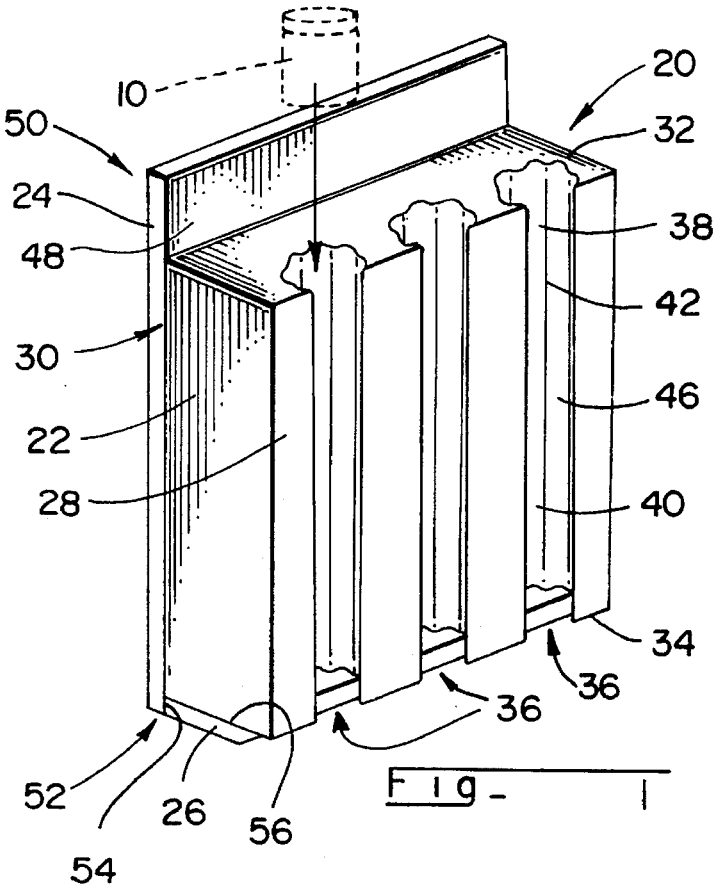
FIG. 1 is a perspective view of a preferred embodiment of a full-access, non-gravity dependent, jar storage rack.

Referring now to the drawings wherein is shown a preferred embodiment and wherein like reference numerals designate like elements throughout the several views, there is shown in FIG. 1 a perspective view of a full-access, non-gravity dependent, jar storage rack in accordance with the present invention and generally indicated by reference number 20. In this embodiment, a jar 10 is shown as being insertable from above the rack 20.

As shown in FIG. 1, the rack 20 includes an elastic body 22, a planar mounting member 24 and a base 26.

The elastic body 22 is seen to include front 28, rear 30, top 32 and bottom surfaces 34 and a plurality of jar receiving bores 36. Each of these bores 36 has top 38 and bottom portions 40, and an interior surface 42 that extends between the body's top 32 and bottom 34 surfaces.

The longitudinal axis of each of the bores 36 is located so that its interior surface 42 intersects the body's front surface 28 so as to define a slot 46 that provides access through the body's front surface 28 to jars stored in the bore 36.

The elastic properties of the body 22 and the bore's diameter are chosen so as to allow the bore's interior surface 42 to be expanded by a jar's entry into the bore 36, and to yield a biasing force against a jar 10 which is sufficient in magnitude to prevent the jar 10 from slipping in the bore 36 under the force of gravity. Foam rubber has been trailed as the elastic body material and found to yield satisfactory performance in this application.

The planar mounting member 24 is seen to have front 48 and rear surfaces 50 and a bottom edge 52. The elastic body's rear surface 30 is secured to the mounting member's front surface 48 by using adhesives or other means.

The base 26 of the rack 20 has a rear edge 54 and a top surface 56, with the rear edge 54 being connected to the planar mounting member's bottom edge 52. In this embodiment, the planar mounting member 24 and the base 26 are molded together from plastic.

Figure 2:
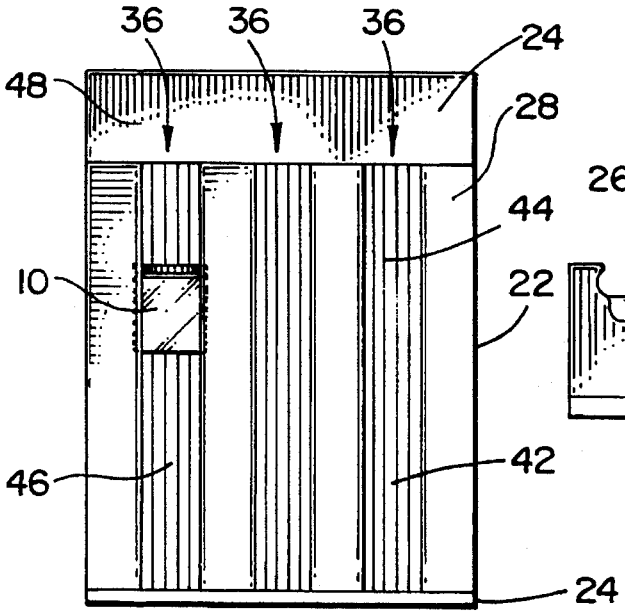
FIG. 2 is a front view of the rack of FIG. 1.

As shown in the front view of FIG. 2, the slot's width is chosen so as to allow a user's fingers to grasp and remove a jar 10 through the slot 46 in the body's front surface 28.

Figure 3:
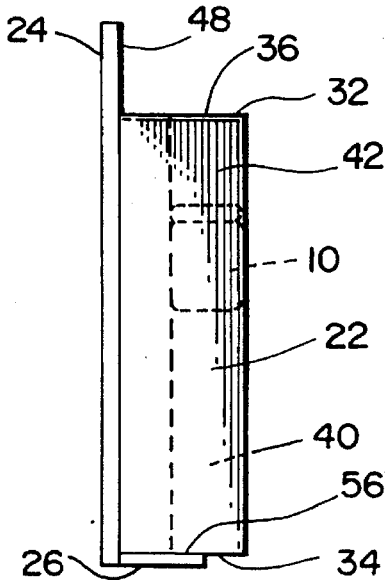
FIG. 3 is a side view of the rack of FIG. 1.

As shown in the side view of FIG. 3, the rack's base 26 is configured so that its top surface 56 prevents jars in the rack's bore 36 from being forced out the bottom portion 40 of the bore 36.

Figure 4:
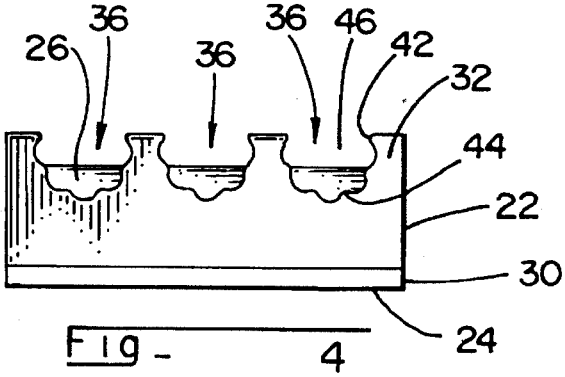
FIG. 4 is a top view of the rack of FIG. 1.

As shown in the top view of FIG. 4, the bore interior surface 42 has corrugations 44 that are aligned parallel to the bore's longitudinal axis. These corrugations 44 allow the bore 36 to accommodate a wider range of jars with differing diameters.

Fasteners may be attached on the planar mounting member's rear surface 50 to allow the rack 20 to be mounted on a wall or door surface.

The preferred embodiments described above are suitable for storing a plurality of jars or cans. These items may be placed in the rack 20 through the top portions 38 of the bores 36 or through the slots 46 in the elastic body's front surface 28.

It thus will be appreciated that a new and improved jar storage rack 20 has been described which achieves the objects of providing full access to all the stored jars and eliminating the possibility for the remaining jars to fall under gravity to fill the void created by the removal of the selected jar.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

We claim:

1. A full-access, non-gravity dependent, jar storage rack, comprising:

an elastic body having front, rear and top surfaces, said body having a jar receiving bore with an interior surface that penetrates into the body from the body's top surface, said bore interior surface intersecting body's front surface so as to define a slot that provides access through the body's front surface to jars stored in the bore;

said elastic properties of the body and the bore's diameter are chosen so as to allow the bore's interior surface to be expanded when accepting jars, thereby yielding a biasing force against the jars which is sufficient to prevent the jars' slippage in the bore under the force of gravity;

said slot having a width chosen so as to allow a user's fingers to grasp and remove a jar through the slot, and a planar mounting member having front and rear surfaces, said elastic body rear surface being secured to the mounting member's front surface.

2. A full-access, non-gravity dependent, jar storage rack as recited in claim 1, wherein:

said bore interior surface having corrugations so as to allow the bore to accommodate a wider range of jars with differing diameters, said corrugations aligned parallel to the longitudinal axis of the bore.

3. A full-access, non-gravity dependent, jar storage rack as recited in claim 1, further comprising:

said elastic body having a bottom surface;

said jar receiving bore having top and bottom portions and extending between the body's top and bottom surfaces;

said planar mounting member having a bottom edge, and a base having a rear edge and a top surface, said rear edge connected to the planar mounting member's bottom edge, said base configured so that its top surface prevents jars in the rack's bore from being forced out the bottom portion of the bore.

4. A full-access, non-gravity dependent, jar storage rack as recited in claim 3, wherein:

said bore interior surface having corrugations so as to allow the bore to accommodate a wider range of jars with differing diameters, said corrugations aligned parallel to the longitudinal axis of the bore.

* * * * *